US006761463B2

(12) United States Patent
Hsu

(10) Patent No.: US 6,761,463 B2
(45) Date of Patent: Jul. 13, 2004

(54) CEILING FIXTURE

(75) Inventor: Kevin Hsu, Taichung (TW)

(73) Assignee: Dong Guan Bright Yin Huey Lighting Co., Ltd., Guan Dong (CN)

( * ) Notice: Subject to any disclaimer, the term of this patent is extended or adjusted under 35 U.S.C. 154(b) by 0 days.

(21) Appl. No.: 10/293,264

(22) Filed: Nov. 14, 2002

(65) Prior Publication Data

US 2004/0095752 A1 May 20, 2004

(51) Int. Cl.[7] ..... F21V 21/02
(52) U.S. Cl. ..... 362/147; 362/362; 362/404
(58) Field of Search ..... 362/145, 146, 362/147, 148, 363, 311, 368, 351, 404, 453, 454

(56) References Cited

U.S. PATENT DOCUMENTS 5,558,537 A * 9/1996 Su ..... 439/537
5,725,190 A * 3/1998 Cuthbertson et al. ..... 248/343
6,004,012 A * 12/1999 Hsieh ..... 362/454
6,005,190 A * 12/1999 Stark et al. ..... 174/66
6,203,279 B1 * 3/2001 Moody et al. ..... 416/244 R

* cited by examiner

*Primary Examiner*—Thomas M. Sember
*Assistant Examiner*—Hargobind S. Sawhney
(74) *Attorney, Agent, or Firm*—Rosenberg, Klein & Lee

(57) ABSTRACT

An improved ceiling feature and particularly a ceiling feature that can be installed easily to anchor a holding dish. It mainly includes a ceiling plate fastened to the ceiling for engaging with a bolt. A holding dish may be coupled with the bolt in the direction of the ceiling. The holding dish has elastic plates which may be depressed to wedge in the screw thread pitches of the bolt to anchor the holding dish. Then a glass shade and a cap may be coupled and a nut may be fastened to complete the installation.

2 Claims, 7 Drawing Sheets

CEILING FIXTURE

BACKGROUND OF THE INVENTION

1. Field of the Invention

The invention relates to an improved ceiling fixture and particularly a ceiling fixture that has elastic plates to latch on the screw thread pitch to anchor a holding dish to facilitate installation of a ceiling lamp.

2. Description of the Prior Art

Conventional ceiling fixtures now available on the market generally are constructed as the one shown in FIGS. 1, 2 and 3. It mainly includes a ceiling plate 2 fastening to a pre-formed cavity 11 on the ceiling 1 through screws. 21. The ceiling plate 2 fastens to a holding dish 31 for coupling with a ceiling lamp 3 through fastening screws 22. The holding dish 31 has fastening holes 311 to receive the fastening screws 22 which are screwed to anchor the holding dish 31. Then a bolt 32 with one end screwing in a screw hole 312 formed on the holding dish 312 and another end coupling with a glass shade 33 and a cap 23, and fastening to a nut 35 to complete the assembly of the ceiling lamp 3. Such a construction has the following disadvantages:

1. Before installation, the fastening screws 22 must be fastened to the ceiling plate 2. Next, the holding dish 31 is coupled from the lower side to the upper side, and the fastening holes 311 of the holding dish 31 are coupled with the fastening screws 22. The holding dish 31 is turned for positioning at a desired location. Then the fastening screws 22 are tightened. Although the actions mentioned above can fasten the holding dish 31 to the ceiling plate 2, they involve many cumbersome operations. As the ceiling plate 2 usually is installed on the ceiling which is high above the floor, people have to climb and work on an elevated location, and have to turn and tighten the fastening screws 22 while holding the holding dish 31 with one hand. It is an inefficient operation.

2. When the holding dish 31 is fastened to the ceiling plate 2, and the bolt 32 is fastened to the screw hole 312 of the holding dish 31, the glass shade 33 and the cap 34 have to be fastened by the nut 35. As the glass shade 33 is quite heavy, it is supported by the bolt 32 fastening to the holding dish 31 which in turn is fastened to the ceiling plate 2 through fastening screws 22, to bear such a heavy load by means of such a support structure is quite risky in the long run.

SUMMARY OF THE INVENTION

In view of the aforesaid disadvantages, the primary object of the invention is to provide an improved ceiling fixture that has a stronger support to bear the heavy weight of the ceiling lamp and is easier to install.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
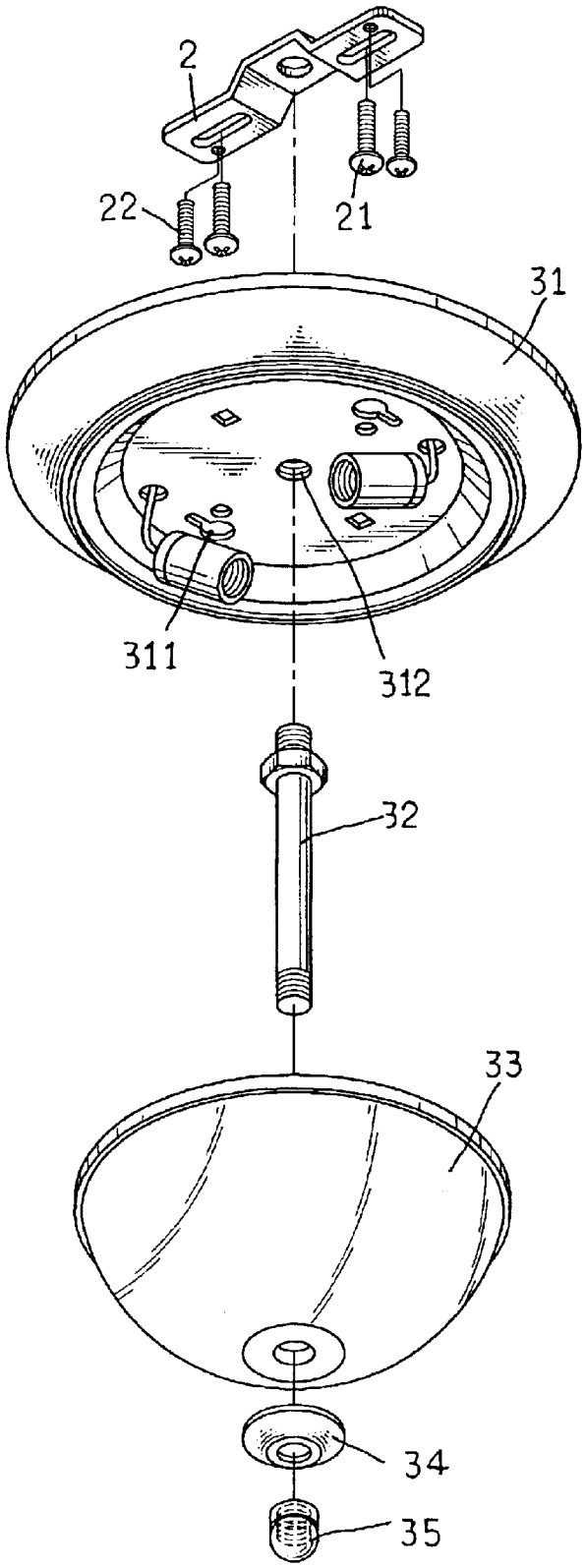
FIG. 1 PRIOR ART
FIG. 1 is an exploded view of a conventional ceiling fixture.
Figure 2:
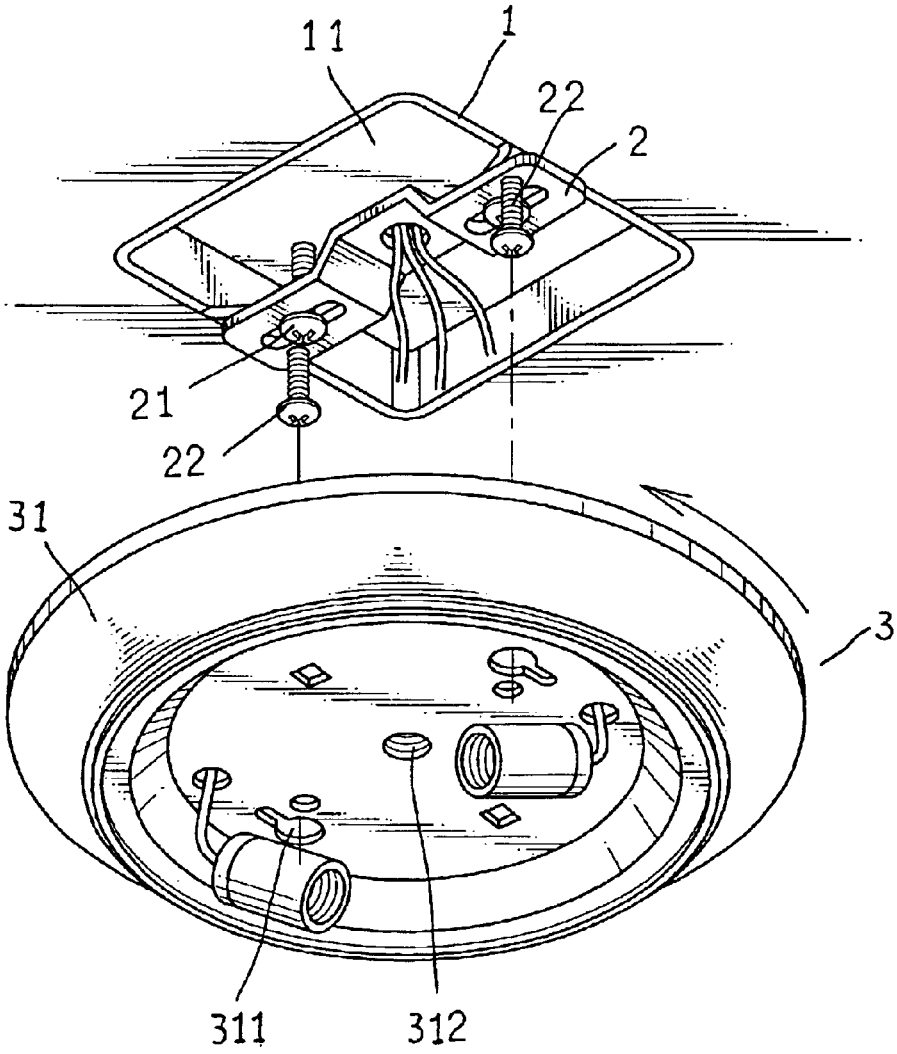
FIG. 2 PRIOR ART
FIG. 2 is a schematic view of a conventional ceiling plate and a holding dish.
Figure 3:
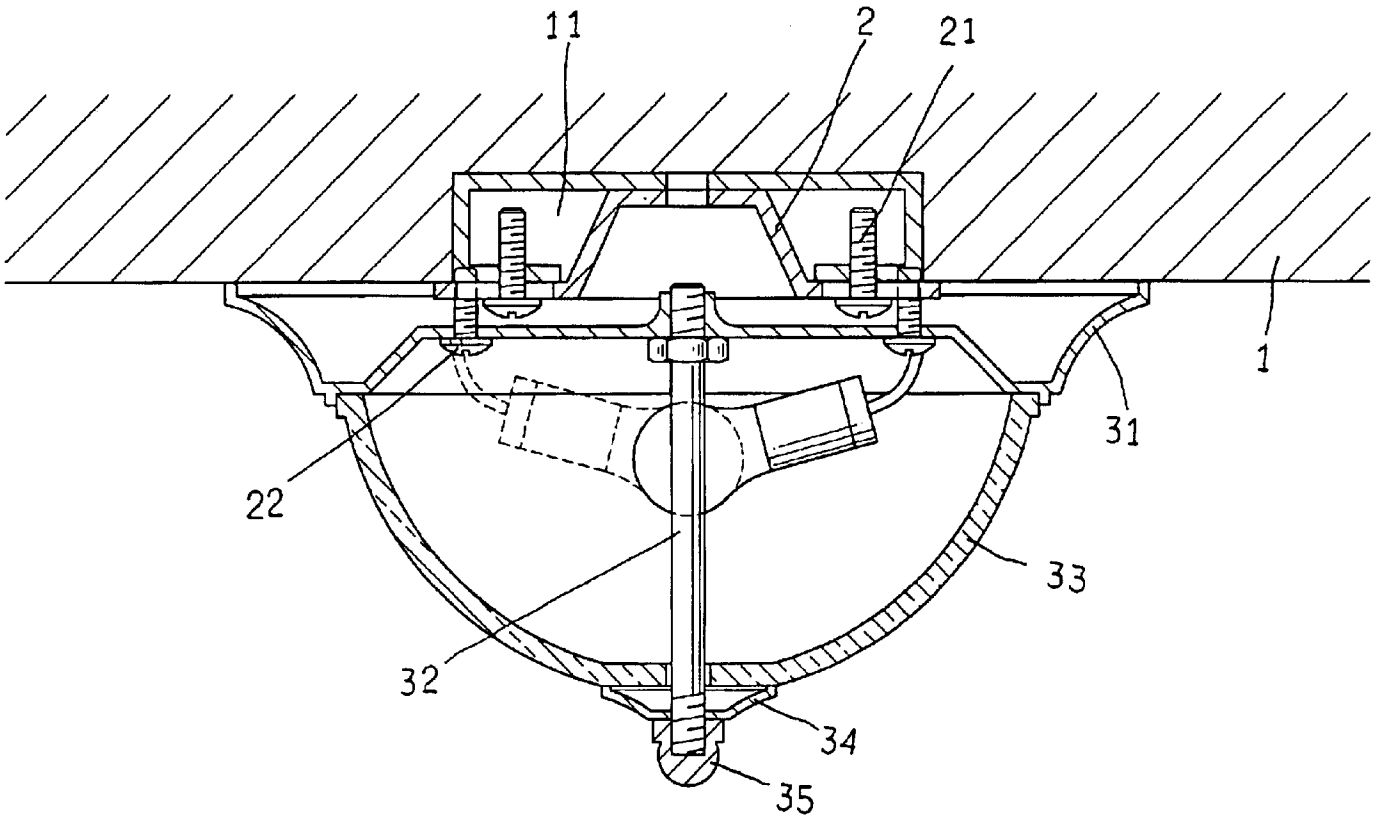
FIG. 3 PRIOR ART
FIG. 3 is a sectional view of a conventional ceiling fixture.
Figure 4:
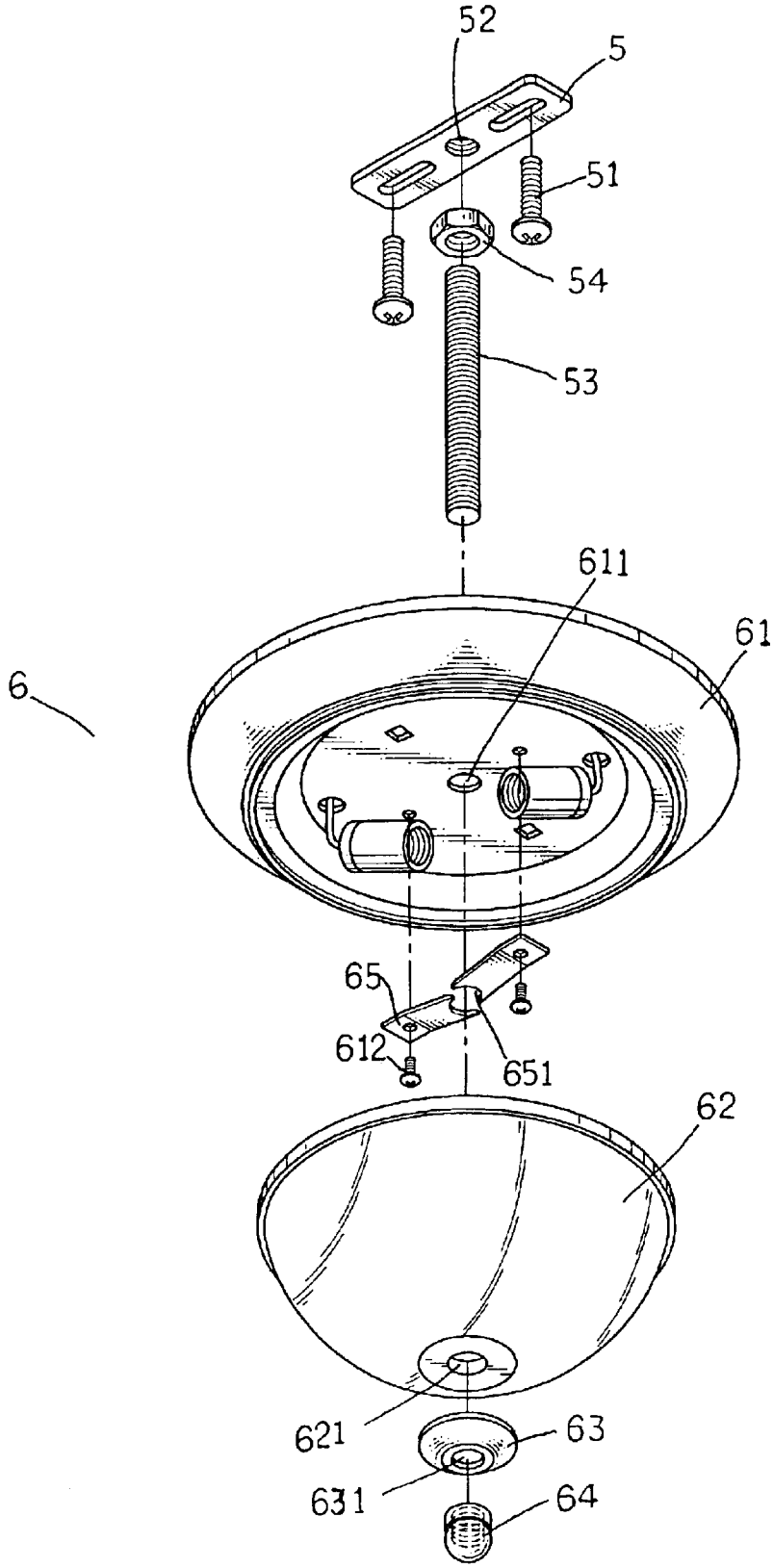
FIG. 4 is an exploded view of the invention.
Figure 5:
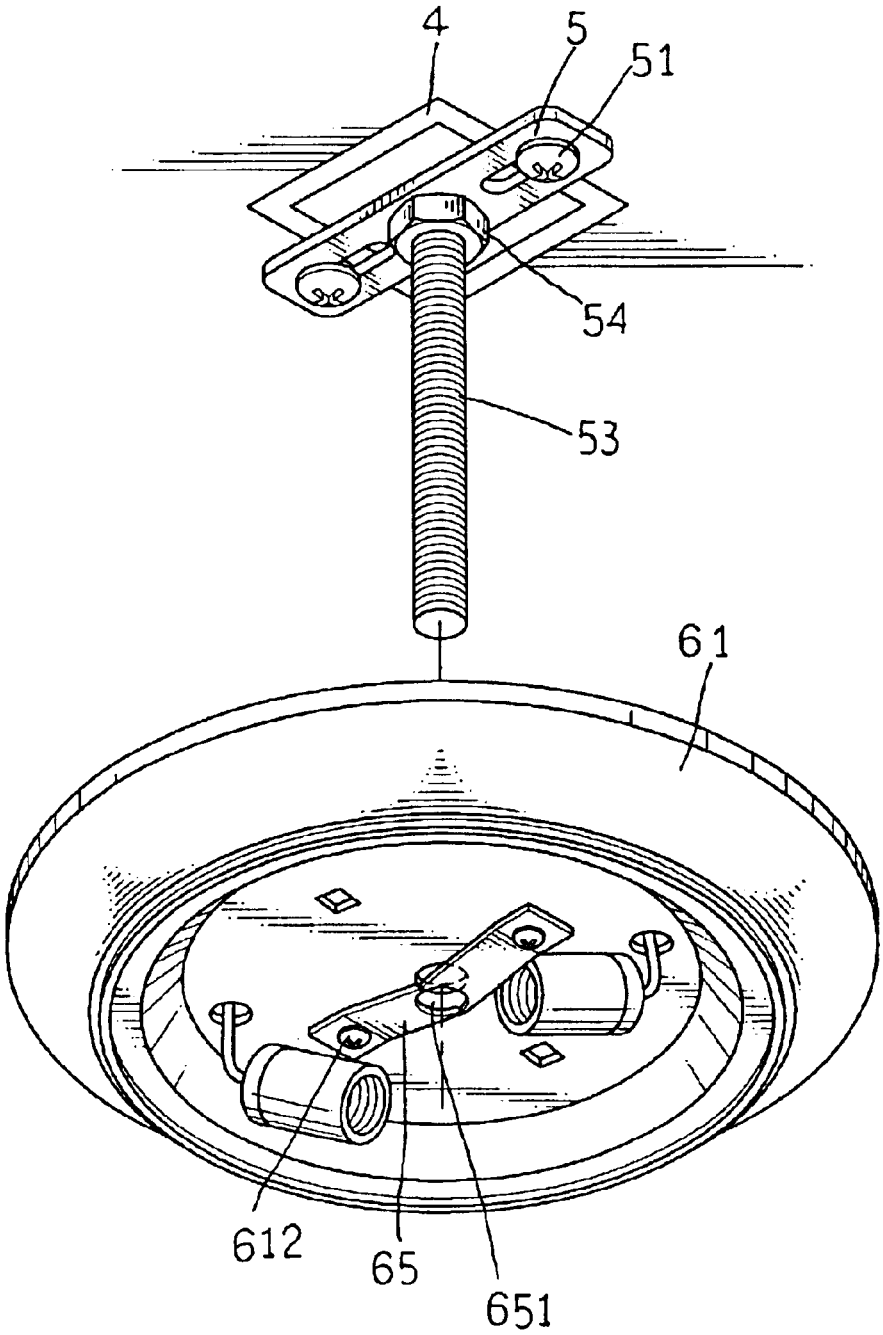
FIG. 5 is a schematic view of a ceiling plate and a holding dish of the invention.

Referring to FIGS. 4 and 5, the invention mainly includes a ceiling plate 5 fastened to the ceiling 4 through screws 51. The ceiling plate 5 has a screw hole 52 to engage with a bolt 53. The bolt 53 is coupled with a fastening nut 54 for fastening the bolt 53 in the screw hole 52.

There is a ceiling lamp 6 which includes a holding dish 61, a glass shade 62, a cap 63 and a nut 64. The holding dish 61 has an opening 611 to enable the blot 53 to run through. The holding dish 61 also has two corresponding elastic plates 65 fastened thereon through screws 612. The elastic plates 65 have respectively one end forming a substantially semi-circular notch 651 facing each other. The glass shade 62 and the cap 63 have apertures 621 and 631 to allow the bolt 53 to run through. The bolt 53 is engaged with a nut 64 for holding the glass shade 62 and the cap 63.

Figure 6:
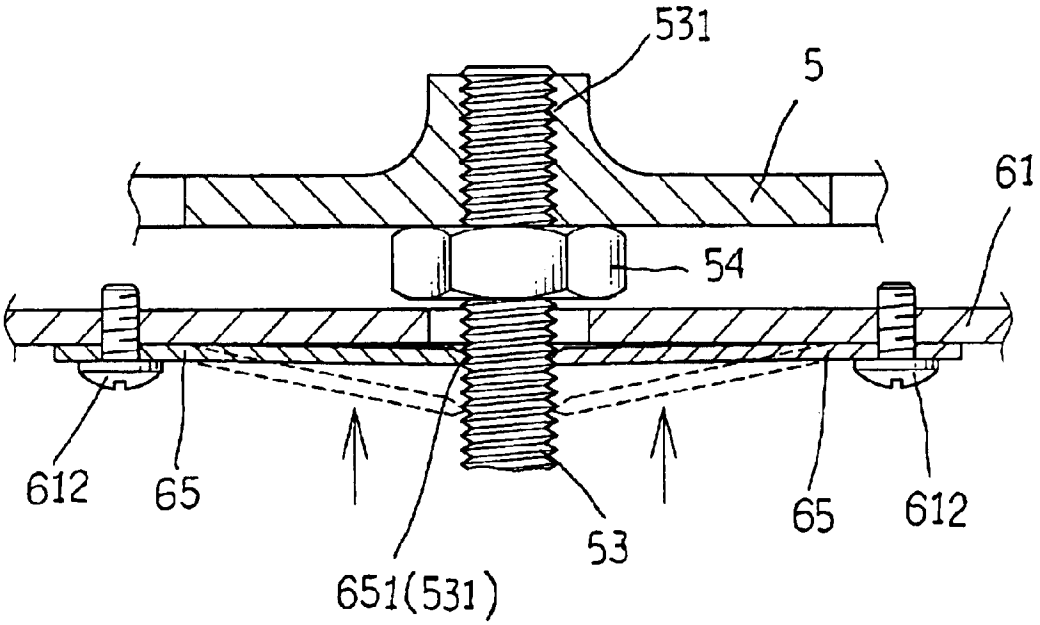
FIG. 6 is a schematic view of the elastic plates of the invention in an operating condition.
Figure 7:
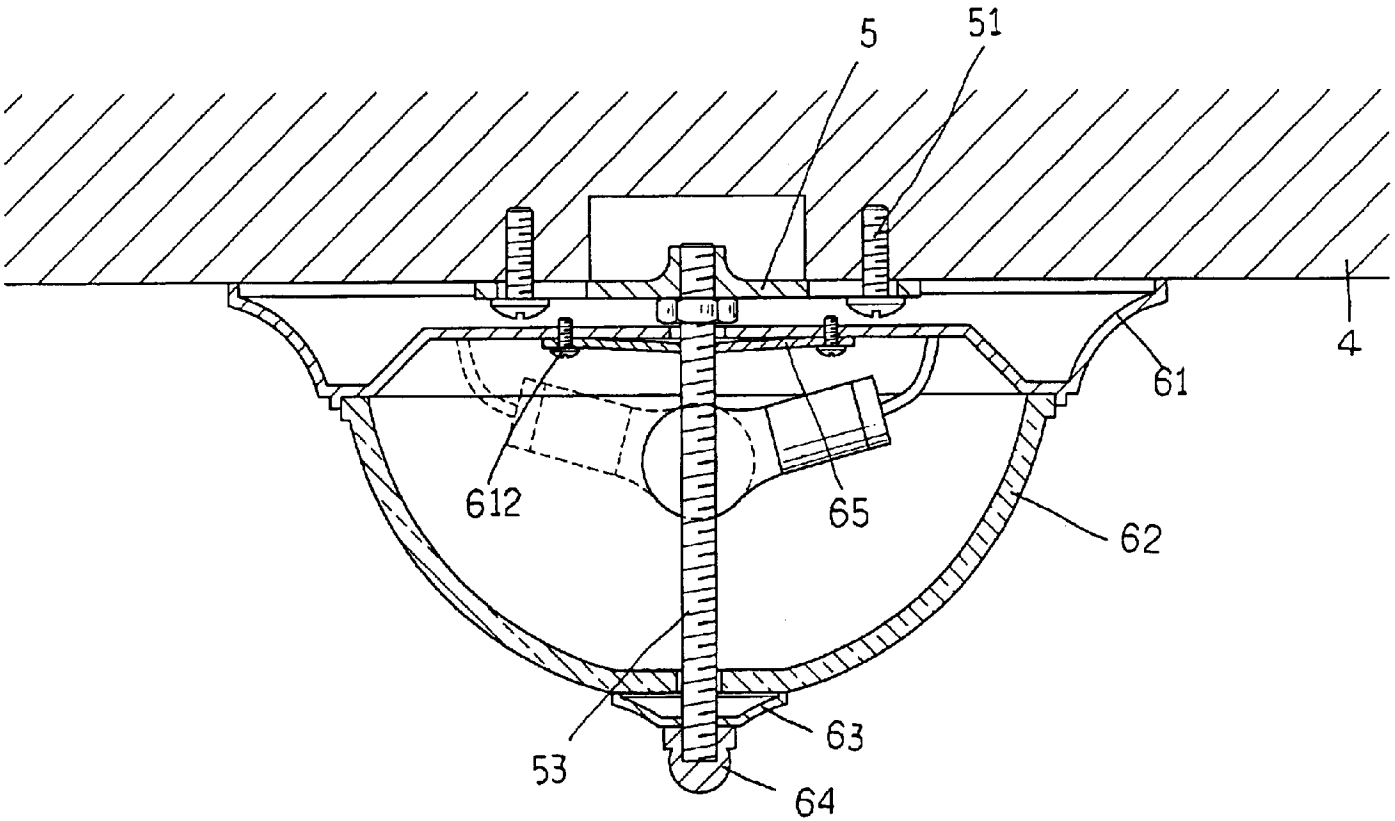
FIG. 7 is a sectional view of the invention.

For installing the ceiling lamp 6, first, engage the bolt 53 with the screw hole 52 on the ceiling plate 5 and fasten the fastening nut 54 tightly to anchor the bolt. Next, fasten the ceiling plate 5 to the ceiling 4, then couple the holding dish 61 on the bolt 53. Before coupling the holding dish 61 on the bolt 53, fasten the elastic plates 65 to the holding dish 61. Thus when the holding dish 61 is coupled on the bolt 53, depress the elastic plates 65 upwards (shown by broken lines in FIG. 6) to wedge the corresponding notches 651 in the screw thread pitch 531 of the bolt 53, the holding dish 61 may be anchored without dropping. Then the glass shade 62 and the cap 63 may be coupled on the bolt 53, and the nut 64 may be coupled with the bolt for fastening (as shown in FIG. 7).

By means of the aforesaid construction and method, users may fasten the ceiling plate 5 coupled with the bolt 53 to the ceiling 4. Then the holding dish 61 with the elastic plates 65 fastened thereon may be coupled to the bolt 53. Press lightly the elastic plates 65 upwards, the holding dish 61 may be anchored. Then the glass shade 62 and the cap 63 may be coupled and fastened to complete the installation.

In summary, by means of the structure and the elastic plates provided by the invention, installation of the ceiling lamp is much easier. Even general consumers can do it without difficulty. And the risky tasks of climbing to a high place to fasten the screws are no longer necessary.

While the preferred embodiment of the invention has been set forth for the purpose of disclosure, modifications of the disclosed embodiment of the invention as well as other embodiment thereof may occur to those skilled in the art. Accordingly, the appended claims are intended to cover all embodiments which do not depart from the spirit and scope of the invention.

I claim:

1. An improved ceiling fixture comprising a ceiling plate fastened to the ceiling with at least two fastening the bolts, a ceiling lamp including a holding dish, a cap, and a nut, the holding dish having an opening formed therethrough, a bolt member extending through the opening;

wherein the holding dish has two corresponding elastic plates fastened thereon through screws, the elastic plates having respective ends facing each other, each end having a substantially semi-circular notch.

2. The improved ceiling fixture of claim 1, wherein the elastic plates are depressable to allow the corresponding notches to wedge in a screw thread pitch of the bolt to anchor the holding dish.

* * * * *